United States Patent [19]

Sooter et al.

[11] 4,213,846

[45] Jul. 22, 1980

[54] DELAYED COKING PROCESS WITH HYDROTREATED RECYCLE

[75] Inventors: Matthew C. Sooter; Lloyd G. Becraft; William H. Kegler, all of Ponca City, Okla.

[73] Assignee: Conoco, Inc., Ponca City, Okla.

[21] Appl. No.: 925,250

[22] Filed: Jul. 17, 1978

[51] Int. Cl.[2] ..... C10G 9/14

[52] U.S. Cl. ..... 208/50; 208/56; 208/131

[58] Field of Search ..... 208/131, 50, 56, 97

[56] References Cited

U.S. PATENT DOCUMENTS

| | | | |
|---|---|---|---|
| 2,922,755 | 1/1960 | Hackley | 208/50 |
| 3,238,118 | 3/1966 | Arey et al. | 208/56 |
| 3,369,992 | 2/1968 | Henke et al. | 208/131 |
| 3,547,804 | 12/1970 | Noguchi et al. | 208/131 |
| 4,043,898 | 8/1977 | Kegler | 208/131 |
| 4,058,451 | 11/1977 | Stolfa | 208/131 |
| 4,090,947 | 5/1978 | Satchell | 208/50 |

*Primary Examiner*—Herbert Levine
*Attorney, Agent, or Firm*—Richard W. Collins

[57] ABSTRACT

A delayed coking process in which the overhead vapors from a delayed coking drum are separated into light hydrocarbon products and a gas oil, and in which the gas oil is hydrotreated after being separated from the light hydrocarbon products. The hydrotreated gas oil is then combined with coker feedstock and fed to the coking drum. The process produces a coke capable of producing a graphitized product having a lower longitudinal coefficient of thermal expansion than that of the coke product produced from the same feedstock by the same process but without the hydrotreating step.

7 Claims, 2 Drawing Figures

DELAYED COKING PROCESS WITH HYDROTREATED RECYCLE

BACKGROUND OF THE INVENTION

1. Field of the Invention

This invention relates to delayed coking of liquid hydrocarbonaceous materials, and more particularly to delayed coking processes directed at production of premium type coke having a low longitudinal coefficient of thermal expansion. (CTE).

The delayed coking process has long been one of the standard processes for converting low value residual liquid hydrocarbonaceous materials into more desirable products. Originally, delayed coking was considered as a process for disposing of such materials by converting them into lighter hydrocarbon products and solid coke, which had utility primarily as a cheap fuel. More recently, it was discovered that certain feedstocks, when subjected to delayed coking at particular conditions, produced a coke which had physical properties making it suitable as raw material for large graphite electrodes which can be used in electric arc furnaces for making steel. This coke, generally designated as premium coke, has certain characteristics which are not found in regular coke produced according to the original delayed coking process.

2. The Prior Art

The distinction between regular coke and premium or needle type coke was first described in U.S. Pat. No. 2,775,549 to Shea, although the "needle" coke described in that patent would not be acceptable in the present premium coke market. The manufacture and properties of premium coke are further described in U.S. Pat. No. 2,922,755 to Hackley.

The use of a hydrotreater to condition coker feedstocks or coker feedstocks combined with recycle is described in several U.S. patents, of which U.S. Pat. Nos. 3,684,688 and 3,891,538 are exemplary. The purpose of the hydrotreater as explained in those patents is primarily to reduce the sulfur level of the feedstock. However, hydrotreating of coker feedstocks has not been widely practiced because of the high capital cost and the short catalyst life inherent in the process.

A process for producing delayed coke in which a recycle stream as well as other overhead components from coke drums are hydrodesulfurized is described in U.S. Pat. No. 4,058,451 to Stolfa.

There has been no description in the prior art of a delayed coking process in which only the recycle gas oil is hydrotreated, and accordingly there has been no indication in the prior art that hydrotreating only the recycle gas oil would reduce the coefficient of thermal expansion of a coke product.

SUMMARY OF THE INVENTION

According to the present invention, the longitudinal coefficient of thermal expansion of a delayed coke product is reduced by hydrotreating the recycle gas oil separated from the coke drum vapors and then combining the hydrotreated gas oil with the fresh feed to the coking operation.

DESCRIPTION OF THE PREFERRED EMBODIMENTS

Figure 1:
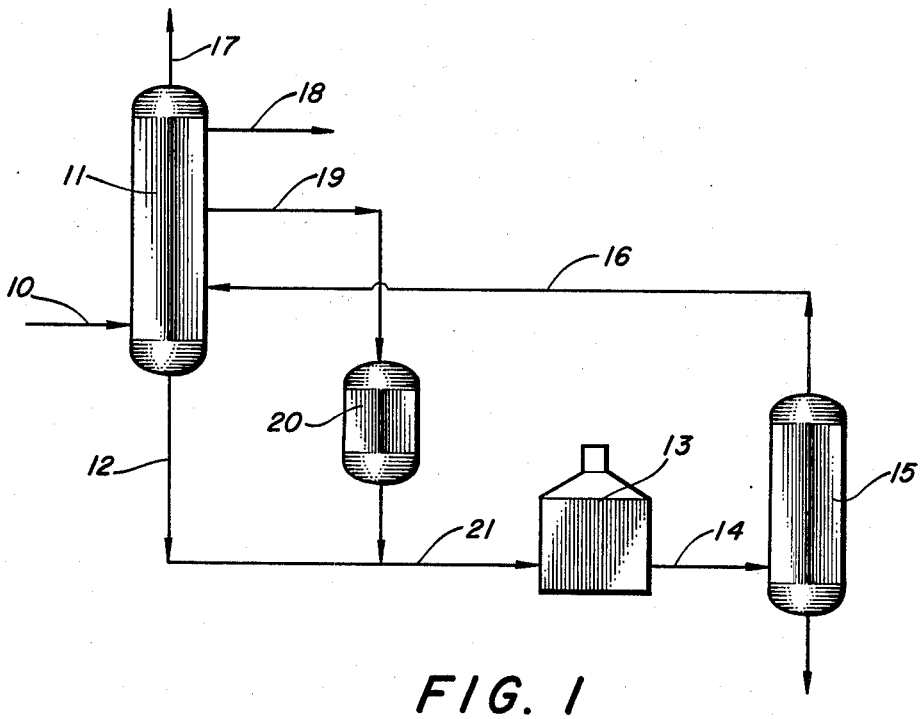
FIG. 1 is a schematic flow diagram illustrating the process of the invention.

In FIG. 1 a delayed coking unit which is conventional except for the capability added by this invention is shown. Coker feedstock from feed line 10 enters the lower section of coker fractionator 11. The feedstock passes relatively unchanged out the bottom of coker fractionator 11 through line 12. The feedstock then is combined with a recycle stream to be described below and passed through line 21 to coker furnace 13 where it is heated to coking temperature. The combined feedstock and recycle then passes through transfer line 14 to coke drum 15 where it is converted to coke product and a volatile overhead stream which is taken out the top of coke drum 15 and returned by overhead line 16 to coker fractionator 11. Light gases and naphtha are recovered through lines 17 and 18 respectively, and a gas oil stream from fractionator 11 is withdrawn through line 19 and passed to hydrotreater 20. The hydrotreater 20 at this particular place in the coking unit constitutes the essential feature of the invention.

As is apparent in FIG. 1, only the recycle gas oil passes through hydrotreater 20, whereas the prior art consistently suggests hydrotreating the entire feed to the coker furnace. When the purpose of the hydrotreating step is to reduce the sulfur level of the coke and/or of other products, the prior art method is appropriate. However, the purpose of the hydrotreating step in the present invention is primarily to reduce the coefficient of thermal expansion (CTE) of the coke product, and more particularly to produce a premium coke product having a very low CTE. In some cases, the invention enables the production of premium coke (defined as coke capable of producing a graphitized article having a longitudinal coefficient of thermal expansion of $5.0\times10^{-7}$° C. or less over the temperature range of 30° to 100° C.) from feedstocks that otherwise are not capable of premium coke production. In other cases, feedstocks that normally can produce premium coke are capable of producing coke having an exceptionally low CTE when the process of this invention is applied to them.

This invention is particularly useful for premium coke production, as there is no particular reason to carry out the recycle hydrotreating if the product is regular coke rather than premium type coke.

Figure 2:
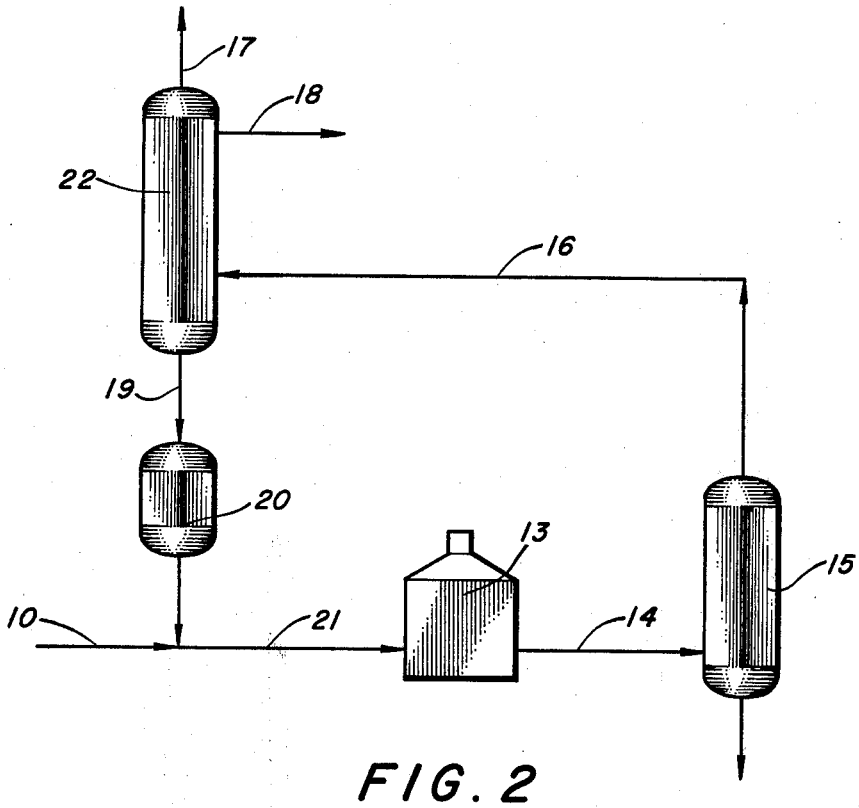
FIG. 2 is a schematic flow diagram illustrating a variation of the process.

A slightly modified process is shown in FIG. 2, in which coker feedstock does not first go through a coker fractionator. Instead, the feedstock is combined directly with hydrotreated recycle and passed through line 21 to coker furnace 13. The fractionator 22 in FIG. 2 does not have to handle the feedstock from line 10, and the gas oil fraction from fractionator 22 is taken from the bottom of fractionator 22.

The coking conditions in the process of the invention are generally conventional premium coking conditions as are known in the art. One exception is that the hydrotreated recycle enables the coker furnace to operate at a slightly higher than normal temperature without coke deposition in the furnace tubes. In the process of the invention, the transfer line temperature between coker furnace 13 and coke drum 15 can be from 505° to 525° C., whereas normally the transfer line temperature is about 470° to 505° C.

The hydrotreating conditions in accordance with the invention can vary considerably, but typically would include a reactor temperature of from 315° to 400° C., a liquid hourly space velocity (LHSV) of from 0.2 to 3, a hydrogen partial pressure of 350 to 2000 psig and a hydrogen rate of from 1000 to 4000 standard cubic feet per barrel of gas oil. A conventional supported nickel-molybdenum or cobalt-molybdenum catalyst is preferred. Specific conditions might include a reactor temperature of 345° C., LHSV of 1.0, hydrogen pressure of 500 psig and hydrogen rate of 2000 standard cubic feet per barrel.

The volume of recycle in line 19 should be between 0.4 and 2.5 times the volume of feedstock from line 10. Preferably, the volume of recycle is about equal to the volume of fresh feedstock.

The essential feature of the invention is that coke CTE can be lowered, and this without the need for hydrotreating anything except the recycle gas oil. The fresh feedstock in this invention is an unhydrotreated liquid hydrocarbonaceous material. If the fresh feedstock were to be hydrotreated in the recycle stream hydrotreater, the catalyst life would be much shorter, the reactor would be much larger, and the costs would be much higher.

Feedstocks for the process of the invention include conventional premium coke feedstocks such as thermal tars, pyrolysis tars, decant oils from fluid bed catalytic cracking, and mixtures thereof. Feedstocks may also include the foregoing materials blended with substantial amounts, such as up to 50 weight percent, of petroleum resid. In some cases, premium coke as defined herein can be produced from a feedstock that would not produce premium coke when subjected to conventional premium coking without the step of hydrotreating recycle.

The utility of the invention is illustrated by the following examples.

EXAMPLE I

In this example, a feedstock consisting of 45 weight percent thermal tar, 40 weight percent petroleum resid and 15 weight percent pyrolysis tar was coked at typical premium coking conditions, and then under essentially the same conditions but with the additional step of hydrotreating the recycle stream. In Table 1 below, Column A represents the conventional run and Column B represents the run with hydrotreated recycle.

Table I

| Conditions | A | B |
|---|---|---|
| Furnace Outlet Temperature | 500° C. | 500° C. |
| Coke Drum Pressure | 60 psig | 60 psig |
| Recycle Ratio (Furnace Feed/Fresh Feed) | 1.44 | 1.46 |
| CTE of Coke Product | $7.2 \times 10^{-7}$/°C. | $4.6 \times 10^{-7}$/°C. |

It can readily be seen from the above data that hydrotreating the recycle enabled production of a premium coke product.

EXAMPLE II

Another pair of runs similar to Example I but with a feedstock consisting of 65 weight percent thermal tar, 20 weight percent petroleum resid and 15 weight percent pyrolysis tar was conducted. In this example, the CTE of the coke product was $6.6 \times 10^{-7}$/° C. for the conventional run and $3.7 \times 10^{-7}$/° C. for the run with hydrotreated recycle.

EXAMPLE III

In this example, two feedstocks were each coked at premium coking conditions, once using and once not using the process of this invention. One of the feedstocks, consisting of a 69/31 weight percent blend of thermal tar and petroleum resid, made a premium coke without the recycle being hydrotreated, and made a better premium coke with the additional step of hydrotreating recycle. The respective CTE's for the products were 4.9 and $4.1 \times 10^{-7}$/° C. The other feedstock, consisting of a 59/41 weight percent blend of thermal tar and petroleum resid, showed a reduction in product CTE of from 6.5 to $4.0 \times 10^{-7}$/° C. by use of the recycle hydrotreating step of the invention.

It has been shown that by hydrotreating the gas oil recycle stream in a coking operation the coke product can be improved. In some cases, premium coke can be obtained by the process of the invention whereas conventional processing of the same feedstock does not produce premium coke. In other cases, even though conventional processing produces premium coke, the quality of the premium coke can be improved, as indicated by a reduced CTE, by the process of the invention.

We claim:

1. In a delayed coking process in which a liquid hydrocarbonaceous premium coke feedstock selected from the group consisting of thermal tar, pyrolysis tar, decant oil from a catalytic cracking operation and mixtures thereof combined with petroleum resid in an amount of up to 50 weight percent is heated in a coker furnace and then fed to a delayed coking drum, and in which overhead vapors from said coking drum are passed to a coker fractionator where they are separated into light hydrocarbon products and recycle gas oil, and in which said recycle gas oil is combined with said feedstock and returned directly to said coking furnace, the improvement wherein said recycle gas oil is hydrotreated after being separated from said light hydrocarbon products and prior to being combined with said feedstock and returned directly to said coking furnace and wherein the coke product from said delayed coking drum has a CTE of less than $5.0 \times 10^{-7}$/° C.

2. The process of claim 1 wherein said gas oil is hydrotreated at a temperature of from 315° to 400° C., an LHSV of 0.2 to 3.0, and a hydrogen partial pressure of from 350 to 2000 psig using a supported cobaltmolybdenum catalyst.

3. The process of claim 1 wherein said feedstock is a blend of thermal tar and petroleum resid.

4. The process of claim 1 wherein the volume of recycle is from 0.4 to 2.5 volumes per volume of said feedstock.

5. The process of claim 1 wherein said feedstock is a premium coke feedstock selected from the group consisting of thermal tar, pyrolysis tar, decant oil from a catalytic cracking operation, and mixtures thereof.

6. The process of claim 1 wherein the combined coker feedstock and recycle gas oil exiting the coker furnace is at a temperature of from 505° to 525° C.

7. The process of claim 1 wherein the feedstock is an unhydrotreated material.

* * * * *